US009799148B2

(12) United States Patent
Whitehouse

(10) Patent No.: US 9,799,148 B2
(45) Date of Patent: Oct. 24, 2017

(54) SYSTEMS AND METHODS FOR ESTABLISHING THE COLORS OF A CUSTOMIZED STAMP

(75) Inventor: Harry T. Whitehouse, Portolo Valley, CA (US)

(73) Assignee: PSI SYSTEMS, INC., Palo Alto, CA (US)

( * ) Notice: Subject to any disclaimer, the term of this patent is extended or adjusted under 35 U.S.C. 154(b) by 1961 days.

(21) Appl. No.: 11/098,807

(22) Filed: Apr. 4, 2005

(65) Prior Publication Data

US 2006/0224403 A1 Oct. 5, 2006

(51) Int. Cl.
*G07B 17/00* (2006.01)
*G09G 5/02* (2006.01)

(52) U.S. Cl.
CPC ..... *G07B 17/00508* (2013.01); *G09G 5/02* (2013.01); *G07B 2017/00064* (2013.01); *G07B 2017/00604* (2013.01)

(58) Field of Classification Search
USPC ..... 705/401; 345/593, 580
See application file for complete search history.

(56) References Cited

U.S. PATENT DOCUMENTS

| | | | | |
|---|---|---|---|---|
| 5,794,223 | A * | 8/1998 | Gallagher et al. | 705/408 |
| 6,655,579 | B1 * | 12/2003 | Delman et al. | 235/375 |
| 7,043,053 | B1 | 5/2006 | Patton et al. | 382/101 |
| 7,243,842 | B1 * | 7/2007 | Leon et al. | 235/381 |
| 2002/0035595 | A1 * | 3/2002 | Yen et al. | 709/203 |
| 2002/0180892 | A1 * | 12/2002 | Cacciatore et al. | 348/649 |
| 2003/0179214 | A1 * | 9/2003 | Saund et al. | 345/619 |
| 2003/0184815 | A1 * | 10/2003 | Shiki et al. | 358/453 |
| 2003/0231185 | A1 * | 12/2003 | Kupersmit | G06F 17/3025 345/589 |
| 2005/0114276 | A1 * | 5/2005 | Hunter et al. | 705/408 |
| 2005/0157926 | A1 * | 7/2005 | Moravec et al. | 382/173 |
| 2006/0082592 | A1 * | 4/2006 | Black-Ziegelbein et al. | 345/605 |

OTHER PUBLICATIONS

Anne-Marie "Her Geekness" Concepcion, Photoshop 7 Text Formatting Trick, Dec. 4, 2003 https://web.archive.org/web/20031204112159/http://www.graphic-design.com/Photoshop/Tips/textfmt.html.*

Seth Burgess, Changing Background Color 1, Apr. 15, 2004 https://web.archive.org/web/20040415041245/http://gimp.org/tutorials/Changing_Background_Color_1/.*

* cited by examiner

*Primary Examiner* — Brian Epstein
*Assistant Examiner* — Rupangini Singh
(74) *Attorney, Agent, or Firm* — Pillsbury Winthrop Shaw Pittman LLP

(57) ABSTRACT

The field of the invention relates to online postage systems, and more particularly to systems and methods for establishing the colors of a customized stamp purchased through an online postage system. In one embodiment, a method is employed for customizing the colors of a customized stamp having a panel and an image. The method includes the steps of enabling a user to select a region of the image, retrieving a color value corresponding to the region of the image, and applying the retrieved color value to a visual feature of the panel, such as the background and text of the panel. The method also maintains a minimum amount of contrast in brightness and color between the background and the text of the panel.

32 Claims, 3 Drawing Sheets

SYSTEMS AND METHODS FOR ESTABLISHING THE COLORS OF A CUSTOMIZED STAMP

FIELD OF THE INVENTION

The field of the invention relates to online postage systems, and more particularly to systems and methods for establishing the colors of a customized stamp purchased through an online postage system.

BACKGROUND OF THE INVENTION

Known online postage systems, such as Endicia™ Internet Postage, enable computer users to purchase U.S. postage and apply individual postage indicia to a wide spectrum of envelopes and labels using standard computer printers. These systems are based on the relatively new concept of Information Based Indicia ("IBI"), wherein information to uniquely identify a particular postage indicium, e.g., postage meter account number and meter piece count, is presented in barcode and/or human readable form on each mailpiece. These user-controlled systems have historically focused on producing complete mail pieces, i.e., these systems produce complete envelopes or labels, which contain the destination address, return address, the postage indicium, the date of mailing, the class mail, optional graphics and branding, and mail processing barcodes, e.g., POSTNET™ or Delivery Confirmation™.

Turning to FIG. 1, the computer environment in which a user may purchase online postage is shown. A user at a personal computer 11 a connects to a server computer 15 configured to enable the user to electronically purchase valid postage, typically via an Internet-type network 20. The user interacts with a software program, e.g., DAZzle™ by Envelope Manager™ Software, on the personal computer 11*a*, downloaded from the server computer 15 and/or installed on the personal computer 11*a*, that allows the user to manage postage purchases (e.g., by printing postage using a printer 11*b* attached to the personal computer 11*a*). Systems of purchasing, printing, and generating online postage are described in U.S. Pat. No. 5,319,562 to Whitehouse, filed Aug. 22, 1991, and U.S. Pat. No. 6,005,945 to Whitehouse, filed Mar. 20, 1997, both of which are herein incorporated by reference in their entirety.

Significantly, the United States Postal Service® ("USPS®") published regulations have historically prohibited the positioning of text or graphics within a certain distance of the indicium area of mail pieces produced with the aforementioned IBI technology. The USPS® rationale has been that the indicium area of the mail piece should not suggest that the USPS® endorses other entities that might be represented by the text or graphics. That is, the indicium (or "stamp") area should only present information relevant to the evidencing of US postage. An exception has been made for postage meter marks created by conventional mechanical postage meters. Provided that the text and/or graphic information has been explicitly approved by the USPS® or one of its authorized postage vendors, e.g., Pitney Bowes™, Neopost™, this information may be printed to the immediate left of the indicium area. The area adjacent to and to the left of the postage indicium area is officially referred to as the "ad-plate area."

The improved security and revenue-protection characteristics of IBI (discussed in U.S. Pat. Nos. 5,319,562 and 6,005,945 referenced above)—coupled with successful customized postage stamp programs in countries such as Australia and Canada—have led the USPS® to consider other forms of IBI postage that resemble conventional postage stamps. For example, the USPS® has considered the concept of closely tying a color graphic image with the postage indicia to create a "customized stamp." FIG. 2 shows an example customized postage stamp 100 that a user may purchase online using IBI technology. The postage stamp 100 generally includes an indicium area 120 having a machine readable signature, such as a barcode 130, that enables the mail delivery service to verify, among other things, that that the postage stamp 100 was validly purchased. Also included in the indicium area 120 is the value of the postage stamp, e.g., $0.37. In addition to the indicium area 120, the stamp 100 may further include one or more personalized photographic or graphic images 110 to be placed in close proximity to the indicium area 120. This stamp can be used in an independent fashion as valid US postage on any envelope or package and is roughly the size of officially published peel-and-stick stamps.

Because the postage stamp 100 is purchased in electronic form, functionally, the only restriction placed on the appearance of the stamp 100 is that identified by the postal authority, e.g., the USPS®. In other words, in addition to customizing the image 110, the software program may enable a user, which can be the individual purchasing the stamp or the individual managing the online postage system, to customize the shape, color, font, size, and layout in accordance with postal regulations. For example, the USPS® will permit the selection of complementary colors for the indicium area 120, or panel 120, behind the indicium IBI 130 barcode as well as the indicium-related text, e.g., "U.S. Postage," "37," piece count, vendor identification, and postage account indicator. An approved USPS® postage vendor, such as Endicia™ or Pitney Bowes™, will be responsible for creating the IBI barcode 130 for each stamp and reviewing all image content submitted for potential use in a stamp design.

The customer applying for the custom stamps will typically choose a photograph or graphic and upload this to a Web-based design platform. Alternatively, the user might open the image with specialized stamp design software running on a local PC. The image might also be selected from an array of "stock" images which have been pre-approved for use. This image will be cropped and framed to fit into the available space on the stamp.

The next user task is to select a complementary background color for the IBI panel 120. Virtually all computer/Web-based systems have a color selection dialog similar to that shown in FIG. 3, which shows a color palette 300 that allows the user to select from a set of discrete colors 310 or from a sliding scale of colors 320. These tools allow a color to be specified in a variety of ways. Users may select a "basic" color or define a custom color in terms of the Red, Green, and Blue intensities ("RGB"), where the intensities have a numerical range from 0 to 255. An alternate means to express the same color value is by the Hue, Saturation, and Luminosity values ("HSL"). These values range from 0 to 240. The average stamp designer will quickly appreciate that selecting a truly complimentary color using this type of dialog is quite difficult. The "basic" colors seldom provide a good match, and selecting a matching custom color can be frustrating for even the most artistically gifted person.

Accordingly, an improved system for establishing the colors of a customized stamp purchased online is desirable.

SUMMARY OF THE INVENTION

The field of the invention relates to online postage systems, and more particularly to systems and methods for establishing the colors of a customized stamp purchased through an online postage system. In one embodiment, a method is employed for customizing the colors of a customized stamp having a panel and an image. The method includes the steps of enabling a user to select a region of the image, retrieving a color value corresponding to the region of the image, and applying the retrieved color value to a visual feature of the panel, such as the background and text of the panel. The method also maintains a minimum amount of contrast in brightness and color between the background and the text of the panel.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

In order to better appreciate how the above-recited and other advantages and objects of the inventions are obtained, a more particular description of the embodiments briefly described above will be rendered by reference to specific embodiments thereof, which are illustrated in the accompanying drawings. It should be noted that the components in the figures are not necessarily to scale, emphasis instead being placed upon illustrating the principles of the invention. Moreover, in the figures, like reference numerals designate corresponding parts throughout the different views. However, like parts do not always have like reference numerals. Moreover, all illustrations are intended to convey concepts, where relative sizes, shapes and other detailed attributes may be illustrated schematically rather than literally or precisely.

DETAILED DESCRIPTION OF THE PREFERRED EMBODIMENTS

Figure 1:
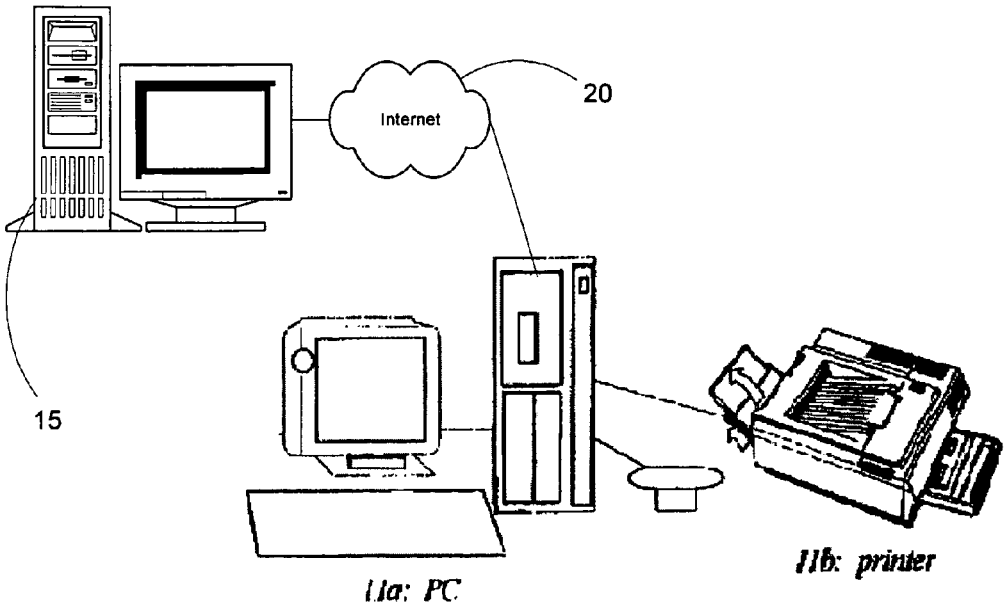
Fig. 1 (Prior Art)
FIG. 1 is a system diagram of an online postage system known in the art.
Figure 2:
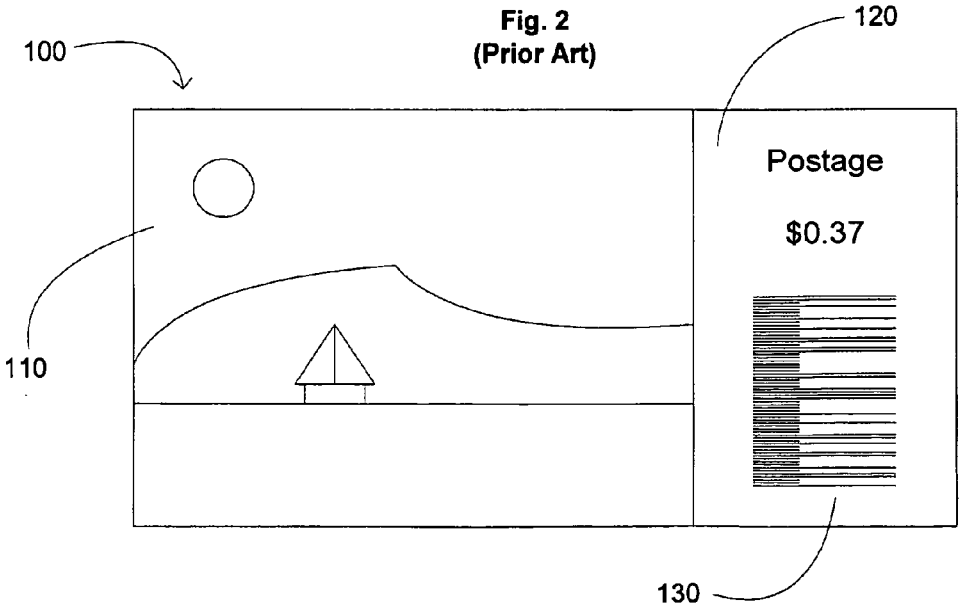
Fig. 2 (Prior Art)
FIG. 2 is an illustration of an online postage stamp known in the art.
Figure 3:
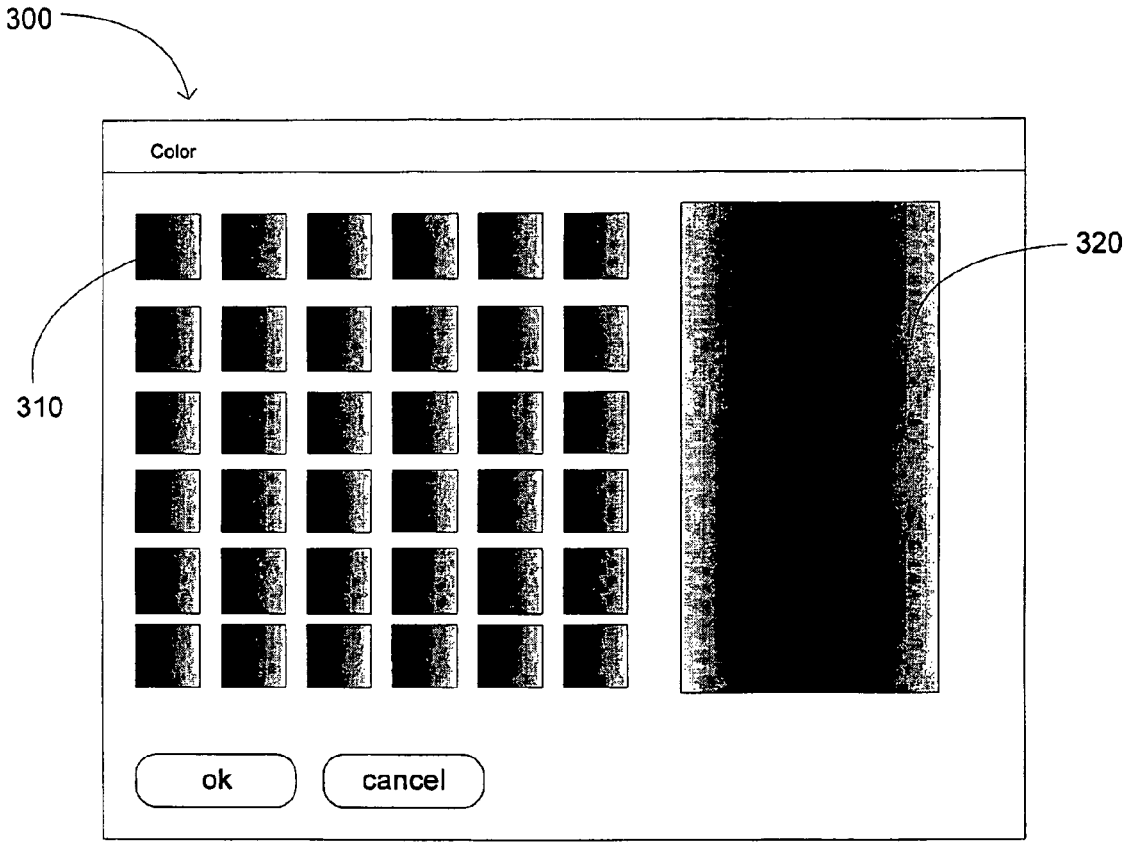
Fig. 3 (Prior Art)
FIG. 3 is an illustration of a color palette known in the art.
Figure 4:
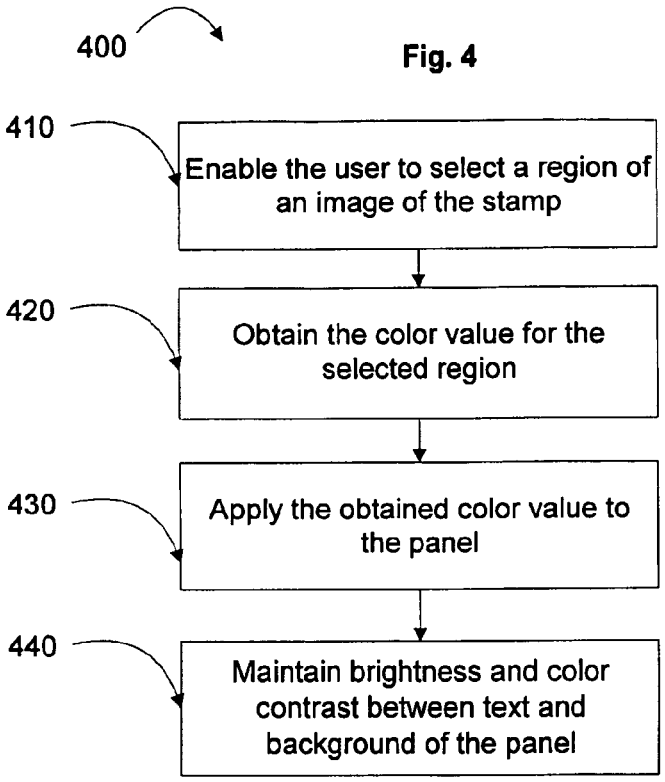
FIG. 4 is a flowchart of a process in accordance with a preferred embodiment of the present invention.

As mentioned above, for a postage stamp 100 such as one shown in FIG. 2, attempting to match the color of the panel 120 of the stamp 100 with the image 110 would be very difficult for many users. Flowchart 400 illustrates a method of facilitating the matching of the color of the panel 120 of the stamp 100 with a region of the image 110 as shown in FIG. 4. According to the process 400, a postage software program, such as the one described above, provides a user with an interface that allows the user to select an area of the image, which can be achieved by allowing the user to position a mouse pointer, or similar pointing device, over a specific area of the image 110 (action block 410). The program then reads the color characteristics matching the desired color of the location of the selected region, e.g., the position of the mouse pointer (action block 420). This action can be performed automatically or in response to a mouse or keyboard command. The color value is preferably established using the RGB model or the HSL model. After the program obtains the desired color value (action block 420), the program then applies the obtained color value to the panel, e.g., the program refreshes background of the panel 120 and/or the text within the panel 120 with the desired color value (action block 430). Thus, the designer and/or user has immediate feedback with respect to the color selection and can quickly explore other sections of their image 110 to see if the image 110 colors in that section make for a complementary panel 120 color. If the user is drawing from RGB values in the image 110, substantially all of the choices for the panel 120 can represent viable color matches.

If the selected area of the image 110 encompasses more than a single point, a variety of weighted RGB averaging computations can be performed over the selected area, which will reveal an "average" color value for the panel 120.

In addition, in order to maintain the readability of the text within the panel 120, it is preferable that the colors of the background and the text maintain a minimum amount of contrast in brightness and/or color (action block 440). For example, if the designer selected a very light blue background color and then chose a white text, the result might be difficult to read with the human eye and/or USPS® imaging systems that process the mail. Thus, it may be preferable to have the program exclude color combinations that result in unreadable color combinations. In one embodiment, if RGB values are used, the contrast in brightness and color are calculated in accordance with the World Wide Web Consortium™. For example, the color brightness, CB, is determined by the following formula:

$$CB=((\text{Red value}\times 299)+(\text{Green value}\times 587)+(\text{Blue value}\times 114))/1000 \quad (1),$$

wherein CB provides a perceived brightness for a color, and the color difference, CD, is determined by the following formula:

$$CD=(\text{maximum}(\text{Red value 1},\text{Red value 2})-\text{minimum}(\text{Red value 1},\text{Red value 2}))+(\text{maximum}(\text{Green value 1},\text{Green value 2})-\text{minimum}(\text{Green value 1},\text{Green value 2}))+(\text{maximum}(\text{Blue value 1},\text{Blue value 2})-\text{minimum}(\text{Blue value 1},\text{Blue value 2})) \quad (2).$$

(This approach is equally applicable to HSL values). Thus, during operation, if a user selects a color for the text of the panel 120, then the program automatically establishes a color for the background of the panel 120 that has sufficient contrast with the color of the text, preferably using one or more of Eqs. 1 and 2 above. Likewise, if the user selects a color for the background of the panel 120, then the program automatically establishes a color for the text of the panel 120 that maintains the desired contrast. If the user/designer chooses colors for both the text and the background, the program can present the contrast values, e.g., results from Eqs. 1 and 2, to the user.

In an alternative embodiment, instead of having the program identify a color that matches the selected region of the image 110 to be applied to the panel 120 (action block 420), the program calculates one or more colors, in accordance with Eqs. 1 and 2, that produces a desirable contrast with the selected region of the image 110 to be applied to the panel 120.

Figure 5:
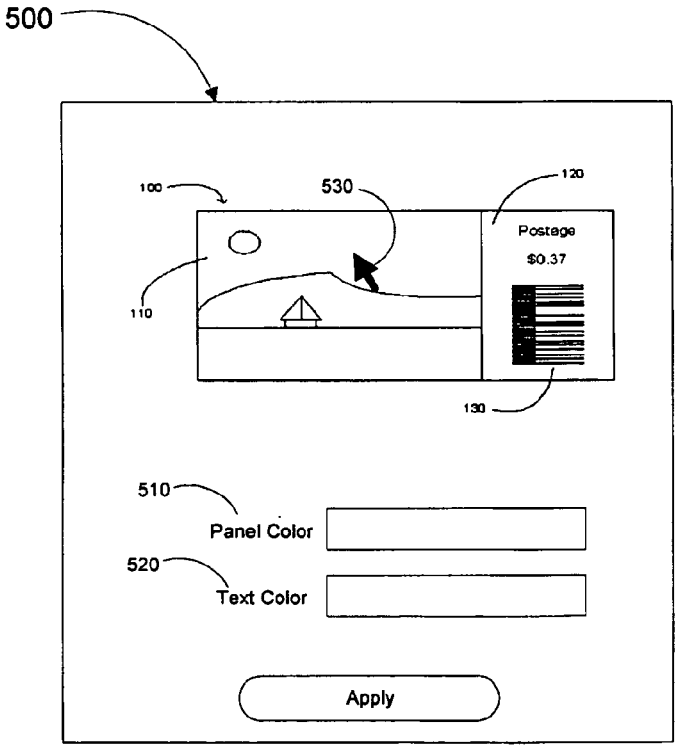
FIG. 5 is a user interface used by a preferred embodiment of the present invention.

Turning to FIG. 5, an example interface 500 employed by the software program to implement the process in FIG. 4 is shown. The software program can reside on a stand-alone client, or in the alternative, the software program can be implemented in a Web design environment, wherein the interface 500 is browser based. The interface 500 allows a user to move a mouse pointer 530 over the image 110 of the postage stamp 100. The software program then obtains the color value, such as the RGB value, that corresponds to the location of the mouse pointer 530. The color value is obtained automatically by the program. In an alternative embodiment, retrieval of the color value can be invoked by the user, preferably in the form of a "right mouse click." The user then identifies whether the color is to be applied to the text of the panel 120 or the background of the panel 120. The program then displays the color value in either the "text color" text box 520 or the "panel color" text box 510, depending upon what the user selects. The display can be in the form of the actual color, a textual identification of the color, and/or the numerical equivalent value. Once the desired color is displayed, the user can review the selection and apply the color to the background, text, and/or other visual features of the panel 120 of the stamp 100. In a preferred embodiment, once either of the panel color 510 or the text color 520 is selected, the program determines a color and/or brightness for the unselected option that provides a desirable contrast between the panel color 510 and the text color 520 so as to maintain readability of the text in the panel 120. The user can adjust the program's determined color if the determined color is undesirable. In the alternative, the contrast values may be displayed to the user if colors for both the background and the text are shown. The net result is that even an artistically-challenged user can upload a birthday or vacation photo, and quickly and easily arrive at a complementary (and readable) color pair for the panel 120 of the customized postage stamp 100. The stamp 100 can be printed at a remote facility controlled by the administrator of the online postage system. Further, the stamp 100 can be created and printed locally by the purchaser of the stamp, preferably subject to review and approval by the administrator.

In the foregoing specification, the invention has been described with reference to specific embodiments thereof. It will, however, be evident that various modifications and changes may be made thereto without departing from the broader spirit and scope of the invention. As an example, each feature of one embodiment can be mixed and matched with other features shown in other embodiments. Additionally and obviously, features may be added or subtracted as desired. Accordingly, the invention is not to be restricted except in light of the attached claims and their equivalents.

What is claimed is:

1. A non-transitory computer-usable medium for facilitating computer-assisted creation of a customized postage item via computer-automated color replacement the computer-usable medium storing computer program instructions that, when executed by one or more processors of a computer system, cause the computer system to execute a method comprising:

providing a presentation of a postage item at a user interface on a display device associated with the computer system, the postage item comprising a region having a background and text over the background;

determining a user-indicated location within the postage item, the user-indicated location indicating a color to be applied to one of the background or the text;

selecting, based on the user-indicated location, a first color for the one of the background or the text;

selecting, without receiving a user indication of a color to be applied to the other one of the background or the text, a second color for the other one of the background or the text based on the second color having a predetermined threshold of contrast in color or brightness to the first color; and causing modification of the presentation of the postage item at the user interface such that a prior color of the one of the background or the text is replaced with the first color and a prior color of the other one of the background or the text is replaced with the second color, the modification of the presentation of the postage item being caused without receiving a user indication of a color to be applied to the other one of the background or the text.

2. The computer-usable medium of claim 1, wherein the user-indicated location indicates a color to be applied to the background, wherein selecting the first color comprises selecting, based on the user-indicated location, the first color for the background, wherein selecting the second color comprises selecting, without receiving a user indication of a color to be applied to the text, the second color for the text based on the second color having the predetermined threshold of contrast in color or brightness to the first color, and wherein causing the modification of the presentation of the postage item comprises causing, without receiving a user indication of a color to be applied to the text, the modification of the presentation of the postage item at the user interface such that a prior color of the background is replaced with the first color and a prior color of the text is replaced with the second color.

3. The computer-usable medium of claim 1, wherein the user-indicated location indicates a color to be applied to the text, wherein selecting the first color comprises selecting, based on the user-indicated location, the first color for the text, wherein selecting the second color comprises selecting, without receiving a user indication of a color to be applied to the background, the second color for the background based on the second color having the predetermined threshold of contrast in color or brightness to the first color, and wherein causing the modification of the presentation of the postage item comprises causing, without receiving a user indication of a color to be applied to the background, the modification of the presentation of the postage item at the user interface such that a prior color of the text is replaced with the first color and a prior color of the background is replaced with the second color.

4. The computer-usable medium of claim 1, wherein determining the user-indicated location comprises determining a location of where an input-device-associated pointer was positioned over the postage item and determining, based on the determined location, the user-indicated location within the postage item, and wherein selecting the first color comprises selecting the first color based on the first color having color characteristics matched to a color associated with a single point corresponding to the user-indicated location on the postage item that the input-device-associated pointer was positioned over when a user input was received.

5. The computer-usable medium of claim 1, wherein determining the user-indicated location comprises determining a location of where an input-device-associated pointer was positioned over the postage item and determining, based on the determined location, the user-indicated location within the postage item, and wherein color values associated with the first color comprise weighted numerical Red, Green, Blue intensities that average color values associated with a plurality of points corresponding to the user-indicated location on the postage item that the input-device-associated pointer was positioned over when the user input was received.

6. The computer-usable medium of claim 1, wherein color values associated with the first color or color values associated with the second color comprise numerical Hue, Saturation, and Luminosity values ranging from zero to two-hundred and forty.

7. A method of facilitating computer-assisted creation of a customized postage item via computer-automated color replacement, the method being implemented by a computer system that comprises one or more processors executing computer program instructions that, when executed by the one or more processors, perform the method, the method comprising:

providing, by the computer system, on a display device, a presentation of a postage item at a user interface, the postage item comprising a region having a background and text over the background;

determining a user-indicated location within the postage item, the user-indicated location indicating a color to be applied to one of the background or the text;

selecting, based on the user-indicated location, a first color for the one of the background or the text;

selecting, without receiving a user indication of a color to be applied to the other one of the background or the text, a second color for the other one of the background or the text based on the second color having a predetermined threshold of contrast in color or brightness to the first color; and causing, at the user interface, modification of the presentation of the postage item such that a prior color of the one of the background or the text is replaced with the first color and a prior color of the other one of the background or the text is replaced with the second color, the modification of the presentation of the postage item being caused without receiving a user indication of a color to be applied to the other one of the background or the text.

8. The method of claim 7, wherein the user-indicated location indicates a color to be applied to the background, wherein selecting the first color comprises selecting, based on the user-indicated location, the first color for the background, wherein selecting the second color comprises selecting, without receiving a user indication of a color to be applied to the text, the second color for the text based on the second color having the predetermined threshold of contrast in color or brightness to the first color, and wherein causing the modification of the presentation of the postage item comprises causing, without receiving a user indication of a color to be applied to the text, the modification of the presentation of the postage item at the user interface such that a prior color of the background is replaced with the first color and a prior color of the text is replaced with the second color.

9. The method of claim 7, wherein the user-indicated location indicates a color to be applied to the text, wherein selecting the first color comprises selecting, based on the user-indicated location, the first color for the text, wherein selecting the second color comprises selecting, without receiving a user indication of a color to be applied to the background, the second color for the background based on the second color having the predetermined threshold of contrast in color or brightness to the first color, and wherein causing the modification of the presentation of the postage item comprises causing, without receiving a user indication of a color to be applied to the background, the modification of the presentation of the postage item at the user interface such that a prior color of the text is replaced with the first color and a prior color of the background is replaced with the second color.

10. The method of claim 7, wherein determining the user-indicated location comprises determining a location of where an input-device-associated pointer was positioned over the postage item and determining, based on the determined location, the user-indicated location within the postage item, and wherein selecting the first color comprises selecting the first color based on the first color having color characteristics matched to a color associated with a single point corresponding to the user-indicated location on the postage item that the input-device-associated pointer was positioned over when a user input was received.

11. The method of claim 7, wherein determining the user-indicated location comprises determining a location of where an input-device-associated pointer was positioned over the postage item and determining, based on the determined location, the user-indicated location within the postage item, and wherein color values associated with the first color comprise weighted numerical Red, Green, Blue intensities that average color values associated with a plurality of points corresponding to the user-indicated location on the postage item that the input-device-associated pointer was positioned over when the user input was received.

12. The method of claim 7, wherein color values associated with the first color or color values associated with the second color comprise numerical Hue, Saturation, and Luminosity values ranging from zero to two-hundred and forty.

13. The method of claim 7, wherein the postage item comprises a barcode representing a postage indicium, and wherein the text comprises text to indicate that the postage item represents United States postage and text to indicate one or more of a monetary value, a piece count, a vendor identification, and a postage account associated with the postage indicium.

14. The method of claim 7, further comprising:

calculating a perceived brightness associated with the first color based on color values associated with the first color and one or more predetermined formulas;

calculating a perceived brightness associated with the second color based on color values associated with the second color and the one or more predetermined formulas; and determining whether the second color maintains the predetermined threshold of contrast in color or brightness to the first color based on the perceived brightness associated with the first color and the perceived brightness associated with the second color.

15. The method of claim 7, further comprising:

obtaining, subsequent to the modification of the presentation of the postage item, a user input to replace the second color for the other one of the background or the text with another color for the other one of the background or the text; and responsive to the user input to replace the second color, causing further modification of the presentation of postage item at the user interface such that the second color for the other one of the background or the text is replaced with the other color.

16. The method of claim 7, wherein determining the user-indicated location comprises determining a location of where an input-device-associated pointer was positioned over the postage item when a mouse input command was received and determining, based on the determined location, the user-indicated location within the postage item.

17. The method of claim 16, wherein the mouse input command comprises a right click mouse command.

18. The method of claim 7, wherein determining the user-indicated location comprises determining a location of where an input-device-associated pointer was positioned over the postage item when a keyboard input command was received and determining, based on the determined location, the user-indicated location within the postage item.

19. A system for facilitating computer-assisted creation of a customized postage item via computer-automated color replacement, the system comprising:

a computer system comprising one or more processors programmed to execute computer program instructions that, when executed by the one or more processors, cause the computer system to:

provide, at a user interface, a presentation of a postage item, the postage item comprising a region having a background and text over the background;

determine a user-indicated location within the postage item, the user-indicated location indicating a color to be applied to one of the background or the text;

select, based on the user-indicated location, a first color for the one of the background or the text;

select, without receiving a user indication of a color to be applied to the other one of the background or the text, a second color for the other one of the background or the text based on the second color having a predetermined threshold of contrast in color or brightness to the first color; and cause, at the user interface, modification of the presentation of the postage item such that a prior color of the one of the background or the text is replaced with the first color and a prior color of the other one of the background or the text is replaced with the second color, the modification of the presentation of the postage item being caused without receiving a user indication of a color to be applied to the other one of the background or the text.

20. A The system of claim 19, wherein the user-indicated location indicates a color to be applied to the background, wherein selecting the first color comprises selecting, based on the user-indicated location, the first color for the background, wherein selecting the second color comprises selecting, without receiving a user indication of a color to be applied to the text, the second color for the text based on the second color having the predetermined threshold of contrast in color or brightness to the first color, and wherein causing the modification of the presentation of the postage item comprises causing, without receiving a user indication of a color to be applied to the text, the modification of the presentation of the postage item at the user interface such that a prior color of the background is replaced with the first color and a prior color of the text is replaced with the second color.

21. The system of claim 19, wherein the user-indicated location indicates a color to be applied to the text, wherein selecting the first color comprises selecting, based on the user-indicated location, the first color for the text, wherein selecting the second color comprises selecting, without receiving a user indication of a color to be applied to the background, the second color for the background based on the second color having the predetermined threshold of contrast in color or brightness to the first color, and wherein causing the modification of the presentation of the postage item comprises causing, without receiving a user indication of a color to be applied to the background, the modification of the presentation of the postage item at the user interface such that a prior color of the text is replaced with the first color and a prior color of the background is replaced with the second color.

22. The system of claim 19, wherein determining the user-indicated location comprises determining a location of where an input-device-associated pointer was positioned over the postage item and determining, based on the determined location, the user-indicated location within the postage item, and wherein selecting the first color comprises selecting the first color based on the first color having color characteristics matched to a color associated with a single point corresponding to the user-indicated location on the postage item that the input-device-associated pointer was positioned over when a user input was received.

23. The system of claim 19, wherein determining the user-indicated location comprises determining a location of where an input-device-associated pointer was positioned over the postage item and determining, based on the determined location, the user-indicated location within the postage item, and wherein color values associated with the first color comprise weighted numerical Red, Green, Blue intensities that average color values associated with a plurality of points corresponding to the user-indicated location on the postage item that the input-device-associated pointer was positioned over when the user input was received.

24. The system of claim 19, wherein color values associated with the first color or color values associated with the second color comprise numerical Hue, Saturation, and Luminosity values ranging from zero to two-hundred and forty.

25. The system of claim 19, wherein color values associated with the first color or color values associated with the second color comprise numerical Red, Green, and Blue intensities ranging from zero to two-hundred and fifty.

26. The system of claim 19, wherein the computer system is a user device, and wherein the one or more processors of the computer system are one or more processors of the user device.

27. The system of claim 19, wherein the postage item comprises a barcode representing a postage indicium, and wherein the text comprises text to indicate that the postage item represents United States postage and text to indicate one or more of a monetary value, a piece count, a vendor identification, and a postage account associated with the postage indicium.

28. The system of claim 19, wherein the computer system is further caused to:

calculate a perceived brightness associated with the first color based on color values associated with the first color and one or more predetermined formulas;

calculate a perceived brightness associated with the second color based on color values associated with the second color and the one or more predetermined formulas; and determine whether the second color maintains the predetermined threshold of contrast in color or brightness to the first color based on the perceived brightness associated with the first color and the perceived brightness associated with the second color.

29. The system of claim 19, wherein the computer system is further caused to:

obtain, subsequent to the modification of the presentation of the postage item, a user input to replace the second color for the other one of the background or the text with another color for the other one of the background or the text; and responsive to the user input to replace the second color, cause further modification of the presentation of postage item at the user interface such that the second color for the other one of the background or the text is replaced with the other color.

30. The system of claim 19, wherein determining the user-indicated location comprises determining a location of where an input-device-associated pointer was positioned over the postage item when a mouse input command was received and determining, based on the determined location, the user-indicated location within the postage.

31. The system of claim 30, wherein the mouse input command comprises a right click mouse command.

32. The system of claim 19, wherein determining the user-indicated location comprises determining a location of where an input-device-associated pointer was positioned over the postage item when a keyboard input command was received and determining, based on the determined location, the user-indicated location within the postage item.

* * * * *